US006997094B2

(12) United States Patent
Granger

(10) Patent No.: US 6,997,094 B2
(45) Date of Patent: Feb. 14, 2006

(54) DEVICE FOR CONTROLLING AND REGULATING THE PRESSURE OF A ROLL OF MATERIAL IN AN AUTOMATIC-CUTTING DISPENSER

(76) Inventor: Maurice Granger, 17 Rue Marcel Pagnol, Saint Priest En Jarez (FR) 42270

( * ) Notice: Subject to any disclaimer, the term of this patent is extended or adjusted under 35 U.S.C. 154(b) by 0 days.

(21) Appl. No.: 10/897,792

(22) Filed: Jul. 23, 2004

(65) Prior Publication Data

US 2004/0256516 A1 Dec. 23, 2004

Related U.S. Application Data

(63) Continuation of application No. PCT/FR02/04445, filed on Dec. 19, 2002.

(51) Int. Cl.
*B23D 17/00* (2006.01)

(52) U.S. Cl. ..... 83/649; 83/339; 83/949; 225/51; 225/106; 242/564.5

(58) Field of Classification Search ..... 83/649, 83/949, 334, 335, 339; 242/564.1–564.5, 242/418, 598.1, 422.5, 416, 598.5, 598.6; 225/103, 105, 106, 11, 51; 221/30–32
See application file for complete search history.

(56) References Cited

U.S. PATENT DOCUMENTS 1,025,312 A * 5/1912 Rydquist ..... 242/564.1
3,661,664 A * 5/1972 Lundell ..... 156/63
3,734,586 A * 5/1973 Schnyder ..... 242/565
4,621,755 A * 11/1986 Granger ..... 225/96
5,054,706 A 10/1991 Maurice
6,179,243 B1 1/2001 Granger
6,644,155 B2 * 11/2003 Phelps et al. ..... 83/339

FOREIGN PATENT DOCUMENTS

FR 2764278 12/1998

* cited by examiner

*Primary Examiner*—Allan N. Shoap

*Assistant Examiner*—Phong Nguyen

(74) *Attorney, Agent, or Firm*—Heslin Rothenberg Farley & Mesiti P.C.

(57) ABSTRACT

The invention relates to a device for controlling and regulating the pressure of a reel of material in an automatic-cutting dispenser. Each side panel of the dispenser comprises a slot that receives, internally, two flanges which are disposed around said slot in lower and upper horizontal planes thereof and which are used to position and support a pivoting shaft. The shaft receives a flap which passes through each of the side panels, via the slot, and which extends outwards from the side panel. The rear of each reel holder arm comprises a tab which is used to receive and fix a return means. This return means is solidly connected to the flap. In this way, when the reel holder arm is lowered, each of the flaps is articulated and the reel is pressed continuously against the drum.

4 Claims, 4 Drawing Sheets

1c
6a
14
6
5
10
2
8a
13a
13
4
1a
11
3
1b
7

1
5
6a
6
14
10
B
B
8a
13
A
A
11
11
4
2
3
12
9
7

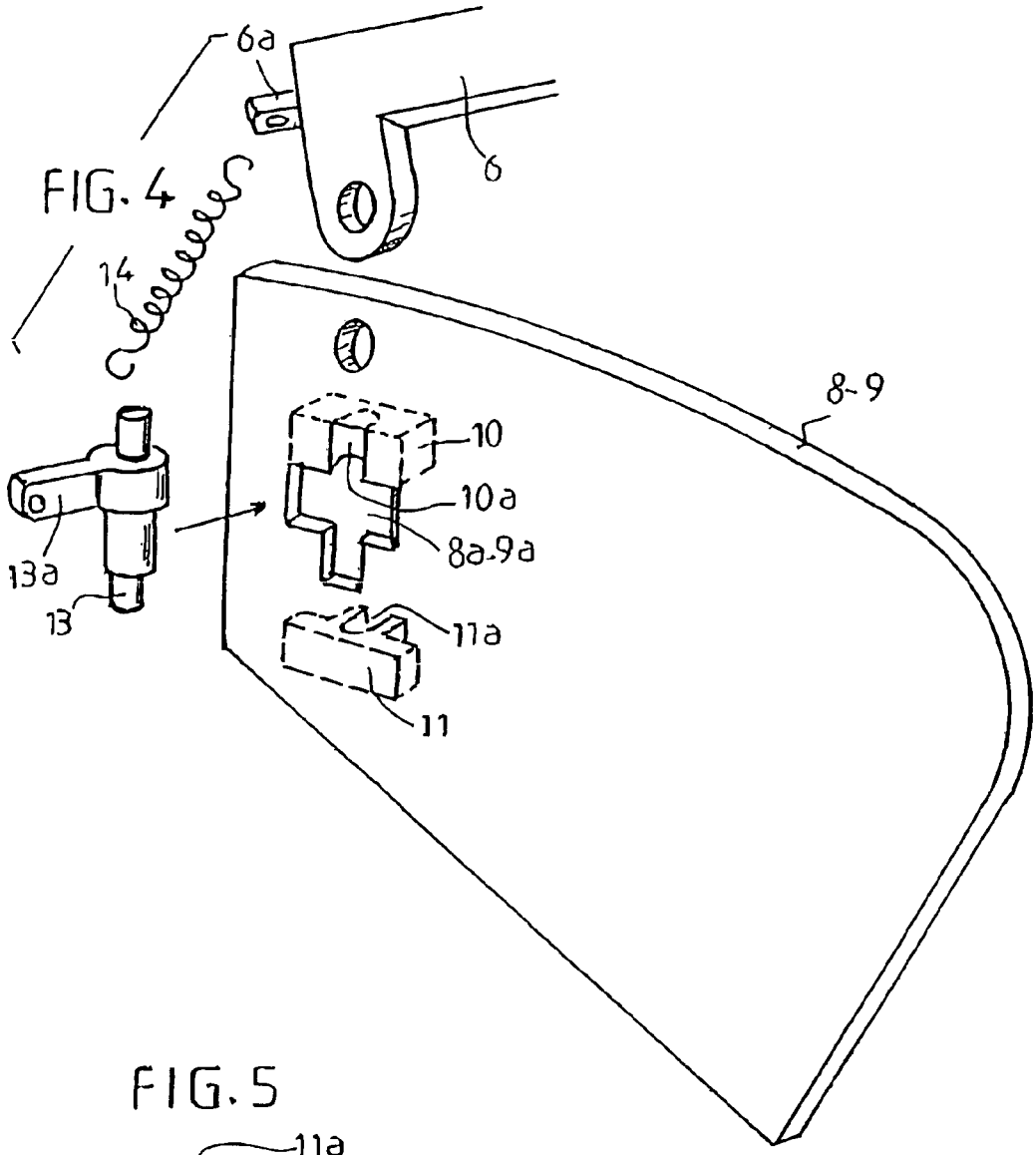
FIG. 4
FIG. 5
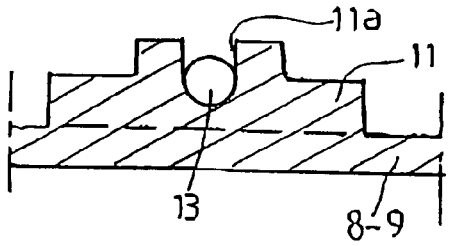
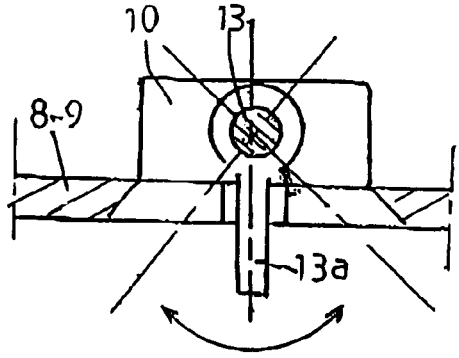
FIG. 6

DEVICE FOR CONTROLLING AND REGULATING THE PRESSURE OF A ROLL OF MATERIAL IN AN AUTOMATIC-CUTTING DISPENSER

CROSS-REFERENCE TO RELATED APPLICATIONS

This application is a continuation of international application PCT/FR02/04445 filed Dec. 19, 2002 and published, in French, as international publication number WO 03/063669 A1 on Aug. 7, 2003, and claims priority from French patent application number 02/01437 filed Feb. 1, 2002, the full contents of these applications being incorporated by reference herein.

The invention relates to the technical field of dispensing machines for wipe material with automatic cutting.

The Applicant has developed machines of this type and they are all designed broadly as follows. They comprise a housing (1) accommodating an articulated protective cover (2). Between the wings of the housing or between lateral end shields separately mounted inside the housing there is a drum (3) which has a non-slip friction area over its periphery associated with a cutting mechanism (4), the reel of material (5) resting on said drum and being articulated on the basis of a reel holder (6). A safety roller (7) is located in the lower part of the machine where the strip leaves the machine and is linked to the drum by means of a guide and transmission belt, thus also making it possible to monitor ejection of the strip of material.

The various mechanisms which enable operation of the drum or its cutting device have been described in many patents filed by the Applicant and in the context of this application, they are independent thereof.

The problem encountered is to control the pressure which the reel of material exerts on the drum during continuous unwinding of said reel after the strip of material has been paid out gradually in accordance with the needs of users and operators.

The Applicant has already worked on this type of problem in connection with dispensing machines with automatic cutting. The prior art as developed by the Applicant is briefly summarised below.

In a first alternative embodiment described in French Patent No. 2621304, the Applicant developed a cam mechanism operated in opposition to an elastic return means in opposition to the reel holder in order to create thrust and press the reel of material against the drum. Such an arrangement is located in the centre of the machine and requires specific modifications to the rear part of the housing and the reel holder. In this embodiment, the central position of the tension regulating device enables the reel holder to swivel but without there being any uniform distribution of pressure along the length of the reel. In fact, it was found that the tensile force exerted on the strip of material by the user prevents regular pressure and, also, the reel of material has a tendency to move sideways due to the effect of the surface roughness of the drum.

The Applicant developed another alternative embodiment of this concept in French Patent No. 2764278. The adjusting device associated with each of the arms of the reel holder includes rails which form slides between the lateral wings of the housing and the reel-holder arms in order to allow sliding and limited displacement of floatingly-mounted sliders over the rails with a monitored and appropriate capability of elastic displacement until the reel is exhausted, the tension being constant.

Although it functions satisfactorily, such an arrangement is nevertheless expensive to implement due to the number of components which need to be made.

The approach adopted by the Applicant was therefore to concentrate on simplifying the mechanisms in order to fulfil the above-mentioned function and rationalise the manufacture of the machine in terms of the moulding dies required in particular.

Having pursued various lines of research, the Applicant settled on implementing a simplified device with a limited number of components which nevertheless offer dependable pressure regardless of the diameter of the reel of material loaded and being used up.

According to a first aspect of the invention, each end shield is designed with a profiled cut-out and internally accommodates, around the cut-out, pairs of flanges arranged either side of the cut-out in lower and upper horizontal planes and enabling positioning and securing of a pivoting shaft and in that each shaft accommodates a flap which passes through each of the end shields through the corresponding cut-out and protrudes externally beyond said end shields and in that the rear part of each end shield has a tab to accommodate and fix a return means which is also attached to said flap, lowering of the reel-holder arm causing articulation of each of the flaps and keeping the reel pushed against the drum with continuous pressure.

These aspects and others will become apparent from the following description.

The object of the present invention is described, merely by way of example, in the accompanying drawings in which:

FIG. 4 is a partial view before assembly showing one of the devices according to the invention and its relationship to the reel-holder arm.

FIG. 5 is a view along line A.A. in FIG. 3.

FIG. 6 is a cutaway view along line B.B. in FIG. 3.

Figure 1:
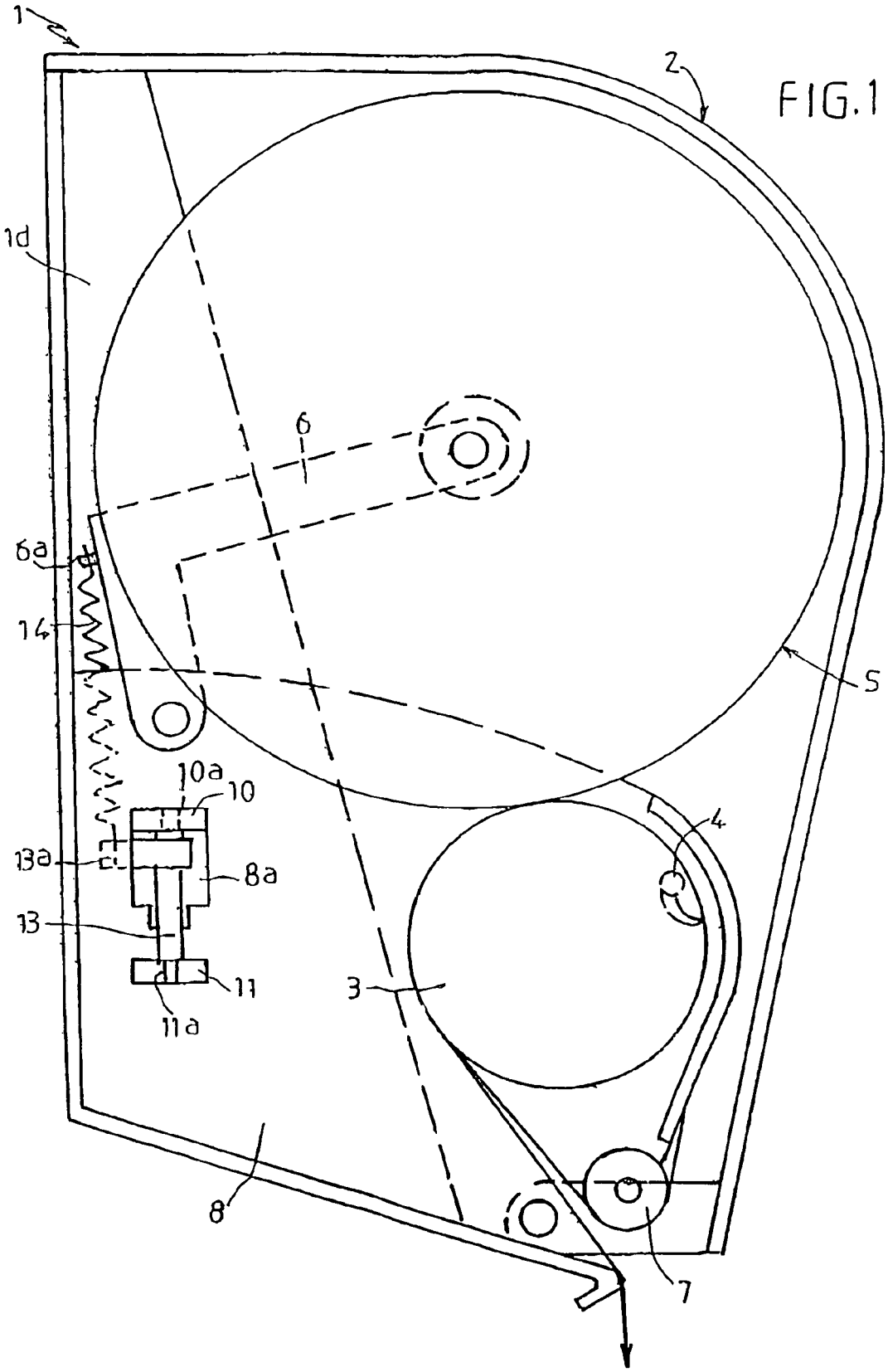
FIG. 1 is a cutaway side view of a wipe material dispensing machine including the device according to the invention with the reel of material full.

In order that the present invention may more readily be understood, the following description is given, merely by way of example, reference being made to the accompanying drawings.

The dispensing machine is referred to in its entirety as (1). It comprises a housing which has a back **(1*a*), a slanting bottom (1*b*) and lateral wings (1*c*) and (1*d*). The housing accommodates a swivelling cover (2) of a known type. Separately mounted lateral end shields (8–9) are located inside the space of the housing and are in the form of sheets of plastic detachably mounted on the walls of the housing by any appropriate means. The drum (3) is mounted between these end shields and is associated with cutting mechanism (4). This drum may have any of the characteristics as defined in the Applicant's various patents. The use of a safety roller (7) associated with drum (3) by means of a guide and transmission belt which also makes it possible to monitor and feed the paper out of the machine is shown merely by way of example. A device with a cam (11) and an associated return means (12) which makes it possible to start and return the drum is also shown. The reel of material (5) is mounted, in a known manner, either on a gantry or reel-holder (6) which is articulated on shafts (6*a*) located in the rear part of above-mentioned lateral end shields (8–9**). The structure of the reel holder and its bent arms is designed in different ways in accordance with previous patents filed by the Applicant. As shown in the drawings, the reel is intended to press against the drum with the strip of material being pressed against the drum, transported and emerging towards the rear of the machine.

According to the invention, the device the purpose of which is to ensure tension control and regulation whilst constantly holding the reel of material against the drum, is implemented as follows.

As shown in FIG. 4, the rear part of each of the end shields (8–9) which support the drum and allow articulation of the reel-holder arm is designed with a profiled cut-out (8*a*–9*a*) in the shape of a cross for example and located between two clamps or flanges (10–11) located on the inside of above-mentioned end shields. These flanges are arranged horizontally in the upper and lower parts of each of above-mentioned cut-outs. These flanges make it possible to accommodate and position a pivoting shaft (13). The pairs of flanges have a fork shape (10*a*–11*a*) with a central gap (10*b*–11*b*) to enable positioning and retention of above-mentioned guide shaft (13). This shaft advantageously has a shoulder at its ends so that it can be positioned and inserted between the two flanges, ensuring it is secured relative to said flanges. The shaft according to the invention is designed with a flap (13*a*) positioned at right angles and in a horizontal plane and passing through the opposite-facing cut-out and externally protruding beyond the plane of each end shield (8–9). This flap is moulded together with the shaft as a single component and is capable of pivoting with said shaft and thus, as shown in FIG. 6, of being moved to one side or the other of above-mentioned cut-out (8*a*–9*a*) at an angle of approximately 180°. The flap is therefore capable of assuming two opposite positions in the right-hand and in the left-hand ends of the cut-out due to lateral displacement. In addition, each reel-holder arm has a bent configuration with a protruding end tab (6*a*). An elastic return means (14) of the spring type is fastened to each of said tabs on the one hand and to the end of the flap (13*a*) on the other hand. There is therefore an elastic link which creates tension between the reel-holder arm and the swivelling flap of the controlling and regulating device.

When the reel of material is full, said flap faces the side of the housing and due to its position has the effect of lightening the reel which presses on the drum. When the reel is nearly exhausted, said flap is moved sideways and is therefore closer to the drum. In its intermediate position which corresponds to the dead centre where the diameter of the reel has reduced by roughly half, said return means (14) is substantially in a vertical plane and does not exert any particular pressure. The positioning of the flap relative to its dead centre in one direction or the other depending on the diameter of the reel either causes the reel to exert less pressure against the drum or more pressure.

Figure 2:
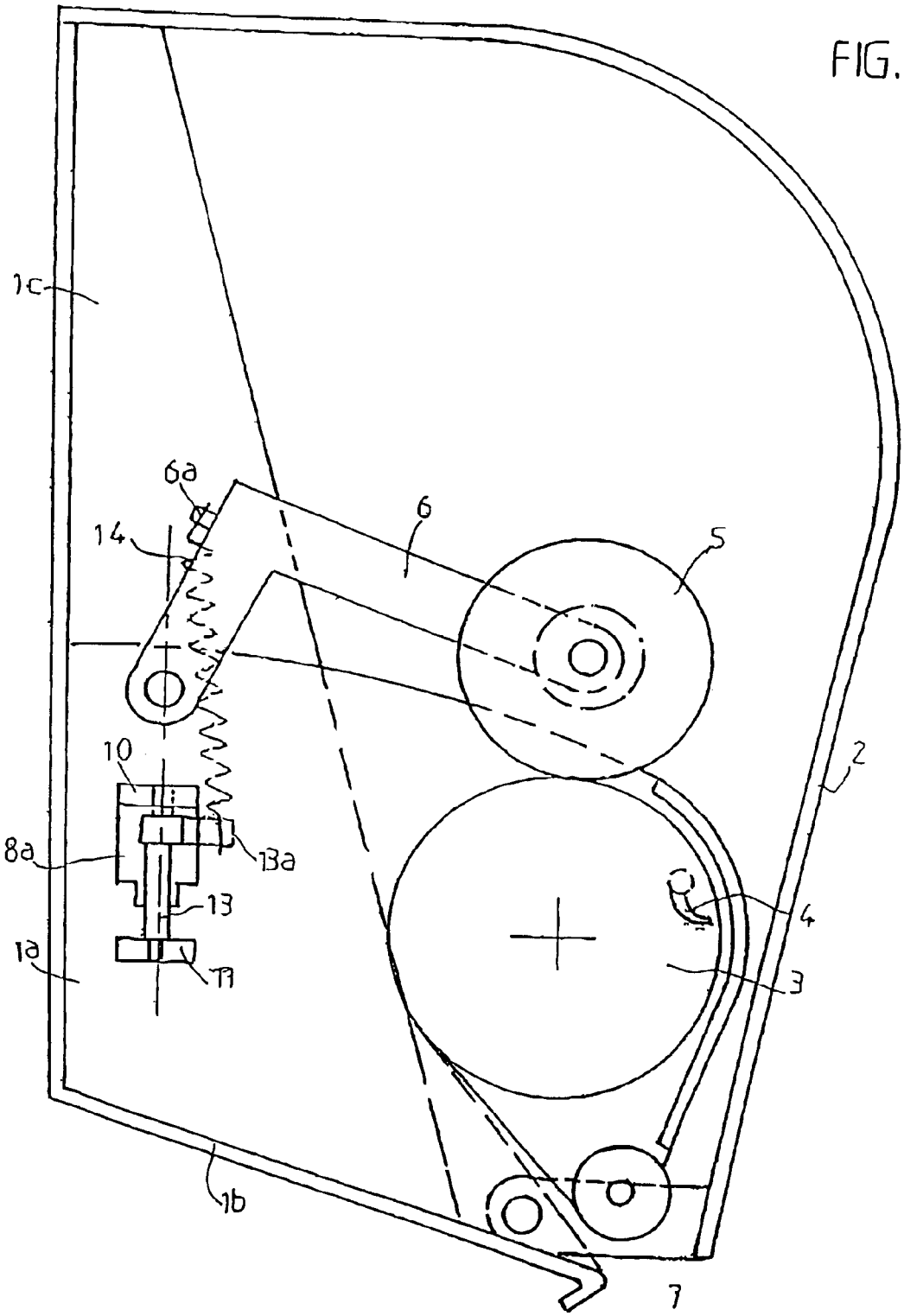
FIG. 2 is a view identical to FIG. 1 but with the reel of material having a substantially reduced diameter due to users having used up a significant quantity of wipe material and showing the position of the device.
Figure 3:
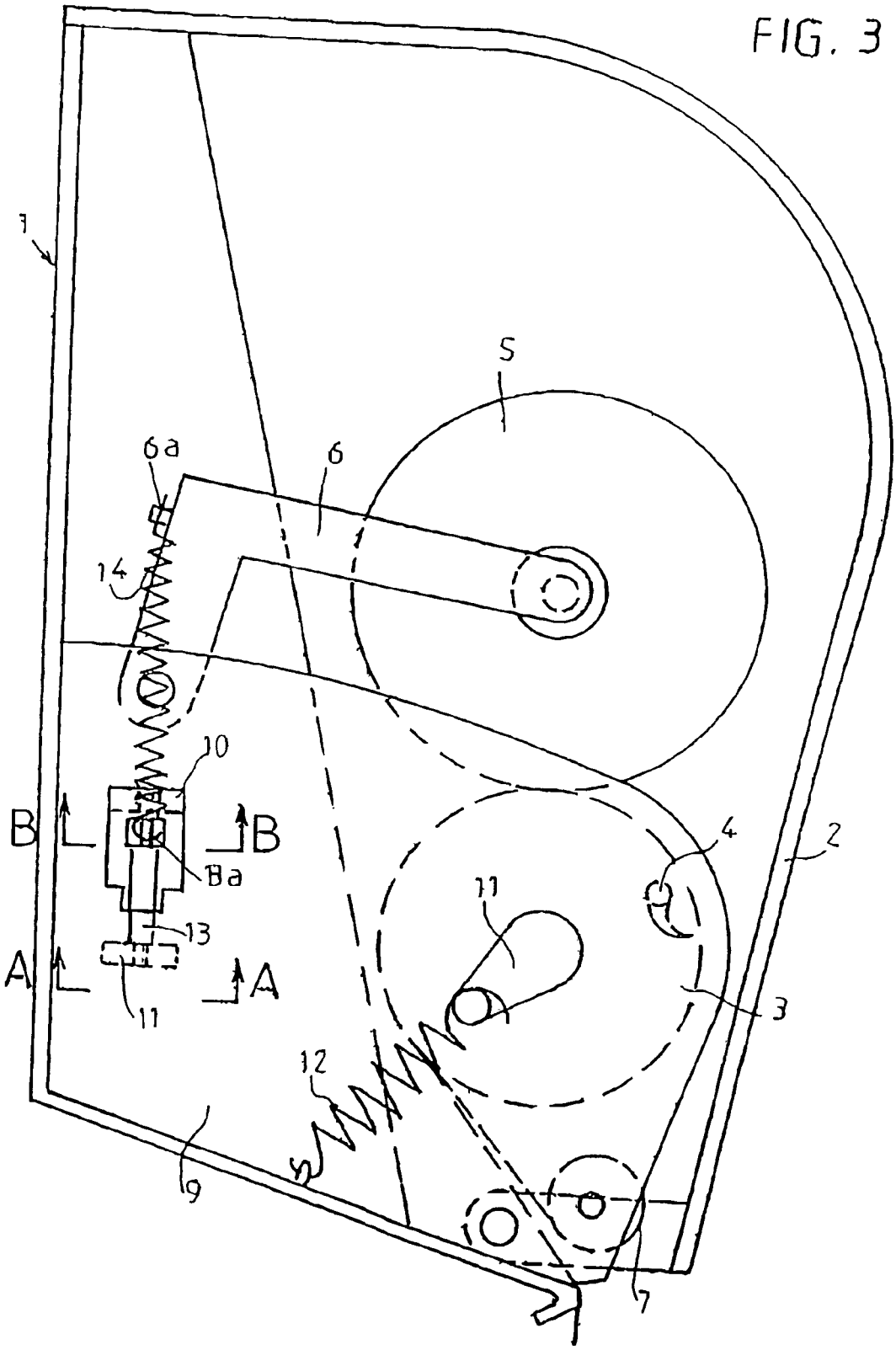
FIG. 3 is a view of the dispensing machine from the other side in an intermediate loading position of the reel.

According to the invention, paying out the reel of material causes movement of the reel-holder arm in a forward swivelling direction. This swivelling is amplified until the reel of material is completely exhausted. Forward swivelling of the two reel-holder arms causes displacement of the end tabs associated with the arms so that, due to the link with the elastic means, this causes gradual pivoting of each of the flaps. The flaps, as shown in FIGS. 1 and 2, move from one end position to the other end position at 180°. always producing tension on the elastic element. In this situation, the reel of material is therefore constantly pressed against the drum. Transition to the dead centre takes place when the reel has essentially been half unwound, thus enabling the return means to exert the desired pressure effect. The proposed solution is simple to implement because it uses a limited number of components and ensures control of the firm pressure exerted by the reel against the drum. Fitting the swivelling device during manufacture is simple and it fulfils the desired function.

Interestingly, the flanges are shaped by moulding them together with end shields (8–9) and this makes it possible to reduce the number of components.

Cut-out (8*a*–9*a*) advantageously has a cross shape but it may also have any other configuration, the essential point being that it makes it possible to move, position and articulate the flap.

What is claimed is:

1. Device for controlling and regulating pressure exerted by a reel of material in a machine for dispensing a strip of wipe material, the machine being of the type comprising a housing which accommodates a protective cover, lateral end shields, a drum associated with a cutting mechanism, and a reel holder including a pair of reel-holder arms, wherein each end shield has a profiled cut-out and internally accommodates, around the cut-out, a pair of flanges arranged either side of the cut-out in lower and upper horizontal planes and enabling positioning and retention of a pivoting shaft and each shaft accommodates a flap which passes through a respective one of the end shields through a corresponding cut-out and protrudes externally beyond the respective one of said end shields, and each reel-holder arm has a tab to accommodate and fix a return means which is also attached to said flap, lowering of a reel-holder arm causing articulation of each flap and keeping the reel pushed against the drum with continuous pressure.

2. Device as claimed in claim 1, wherein each cut-out has a cross shape.

3. Device as claimed in either claim 1 or 2, wherein each flap is capable of being pivoted from one end to another of the cut-out and moving through an angle of 180°.

4. Device as claimed in claim 1, wherein the flanges are arranged horizontally in upper and lower parts of each cut-out to accommodate and position a respective pivoting shaft, and each pair of flanges has a fork shape with a central gap to enable positioning and retention of the respective pivoting shaft.

* * * * *